US005399285A

United States Patent [19]

Kanluen

[11] Patent Number: 5,399,285

[45] Date of Patent: Mar. 21, 1995

[54] NON-CHLORINATED LOW ALKALINITY HIGH RETENTION CLEANERS

[75] Inventor: Ratana Kanluen, Canton, Mich.

[73] Assignee: Diversey Corporation, Mississauga, Canada

[21] Appl. No.: 969,086

[22] Filed: Oct. 30, 1992

[51] Int. Cl.[6] ..... C11D 3/37; C11D 1/75; C11D 17/00

[52] U.S. Cl. ..... 252/174.23; 252/156; 252/173; 252/174.16; 252/174.21; 252/174.24; 252/546; 252/547; 252/550; 252/551; 252/555; 252/558; 252/559; 252/DIG. 2

[58] Field of Search ..... 252/547, 174.24, 156, 252/546, 174.21, DIG. 11, 174.23, 174.16, DIG. 17, DIG. 2

[56] References Cited

U.S. PATENT DOCUMENTS

| | | | |
|---|---|---|---|
| 3,085,982 | 4/1963 | Steer et al. | 252/137 |
| 3,622,391 | 4/1969 | Baldi | 134/3 |
| 3,793,221 | 2/1974 | Orthalek et al. | 251/136 |
| 3,843,548 | 10/1974 | James | 25/187 |
| 4,005,027 | 1/1977 | Hartman | 252/95 |
| 4,116,851 | 9/1978 | Rupe et al. | 252/103 |
| 4,797,223 | 1/1989 | Amick et al. | 252/174.23 |
| 5,055,219 | 10/1991 | Smith | 252/102 |

FOREIGN PATENT DOCUMENTS

| | | |
|---|---|---|
| 0314232 | 3/1989 | European Pat. Off. . |
| 0373864 | 6/1990 | European Pat. Off. . |
| 0439878 | 8/1991 | European Pat. Off. . |

OTHER PUBLICATIONS

Acusol TM Thickeners for Detergents, Rohm and Haas Company 1990 (no month available).

Acusol TM 810 Acrylic Thickener-Stabilizer, Rohm and Haas Company 1990 (no month available).

Acusol TM 820 Associative Thickener for Use in Household and Industrial Cleaners, Rohm and Haas Company 1990 (no month available).

Acusol TM detergent polymers, physical properties and general application, Rohm and Haas, Apr. 1991.

Derwent abstract accession #84-130965/21, JP 59-66497, Apr. 14, 1984.

Derwent abstract accession#92-305935/37, RD 30045, Aug. 10, 1992.

T. Imae and S. Ikeda, "Formation of Rodlike Micelles of Dimethyloleylamine Oxide in Aqueous Solutions," Colloid and Polymer Sci 263: 756-766 (1985).

M. J. Schick and F. M. Fowkes, "Foam Stabilizing Additives for Synthetic Detergents", J. Phys. Chem., vol. 61, 1062-1068 (1957).

W. M. Sauyer and F. M. Fowkes, "Interaction of Anionic Detergents and Certain Polar Aliphatic Compounds in Foams and Micelles". J. Phys. Chem., vol. 62, 159-166 (1958).

E. J. Staples and G. J. T. Tiddy, "Nuclear Magnetic Resonance Technique to Distinguish Between Micelle Size Changes and Secondary Aggregation in Anionic and Nonionic Surfactants Solutions". Trans. Farady Soc., 2530-2541 (1978) (no month available).

*Primary Examiner*—Linda Skaling
*Assistant Examiner*—A. Hertzog
*Attorney, Agent, or Firm*—Weintraub Duross Brady

[57] ABSTRACT

Non-chlorinated, low alkalinity, high retention liquid hard surface cleaner concentrate and use solutions containing an amine oxide surfactant, an anionic surfactant, a hydrophobically modified polymer surfactant, a thinner, and alkali are provided, which form viscous solutions upon dilution and which in cleaning operations, are capable of producing gel-like foams. The composition synergistically exhibits exceptional cleaning performance without the need of chlorine or high levels of caustic.

16 Claims, No Drawings

NON-CHLORINATED LOW ALKALINITY HIGH RETENTION CLEANERS

BACKGROUND OF THE INVENTION

1. Field of the Invention

The present invention pertains to the field of hard surface cleaners. More particularly, the invention pertains to hard surface cleaners which thicken upon dilution forming a gel-like foam during cleaning operations.

2. Description of the Related Art

In recent years, it has become increasingly desirable to utilize hard surface cleaners which have high viscosities to increase surface contact time, particularly on non-horizontal surfaces. Such liquid products are highly viscous compositions which are used as such, without dilution, or at most modestly diluted. Examples of such products are disclosed in U.S. Pat. Nos. 3,622,1; 3,793,221; 3,843,548; and 4,005,027 and West German Patent DE 3,940,604.

Most recently, attention has been focused upon the development of relatively low viscosity concentrates which thicken, or increase their viscosity, upon dilution to working concentrations Such concentrates are cost effective due to their decreased packaging, transportation, and storage costs. Such concentrates are particularly useful for cleaning operations in the food industry. Several publications address thickening technology, for example H. Hoffmann, *Progr. Colloid Polym. Sci.* 84, pp 24–35 (1991); H. Hoffmann, *Progr. Colloid Polym. Sci.* 83 16–28 (1990); T. Imac and S. Ikada, *Coll. and Pol. Sci.* 13 134 (1985). Thickening technology is further described in European Patents EP 0 265 979, and EP 0 276 501; Great Britain Patent GB 2071688, and West German Patent DE 2359095.

In European patent application EP 0 314 232 compositions are described which thicken upon dilution, and which contain a primary surfactant which may be, inter alia, an amine oxide surfactant or a co-surfactant thereof which may be anionic. However, these compositions, in order to perform their intended function, contain relatively large amounts of amine oxide surfactants, i.e. from 8 to greater than 18 weight percent in the concentrate. The concentrates are then diluted to form working solutions containing from 5 to 15 weight percent of the concentrate. Such compositions are not economical in view of the large concentration of surfactant required of both the concentrate and the working solution. Furthermore, both the final use viscosity as well as the cleaning efficiency is less than desirable. In order to compensate, chlorine bleaches must be added, raising environmental concerns.

OBJECTS OF THE INVENTION

It is an object of the subject invention to prepare hard surface detergent concentrates which have relatively low viscosity yet which are suitable in preparing viscous use solutions at low actives concentration.

It is a further object, of the invention to prepare concentrates which are cost effective in view of their performance.

It is yet a further object of the invention to prepare compositions the use of solutions which enable development of gel-like foams which enhance the residence time of the detergent solution on the surfaces to be cleaned, and which exhibit superior cleaning ability. It is still a further object of the invention to prepare concentrates and use solutions free of chlorine and of low alkalinity so as to provide safe handling.

SUMMARY OF THE INVENTION

These and other objects have been unexpectedly met through the use of formulations comprising an amine oxide surfactant, an anionic surfactant, and a hydrophobically modified surface active polymer surfactant. The compositions of the subject invention further contain chelating and/or sequestering agents, caustic soda or caustic potash, and a minor quantity of a thinner, which is either a solvent, a nonionic surfactant or both.

For a more complete understanding of the present invention reference is made to the following detailed description and accompanying example.

DESCRIPTION OF THE PREFERRED EMBODIMENTS

As heretofore noted, and in accordance herewith, a retention cleaner is provided by a composition comprising:

(a) an amine oxide surfactant, (b) an anionic surfactant, and (c) a hydrophobically-modified surace active polymer surfactant.

The amine oxide surfactant used herein corresponds to the formula:

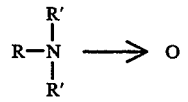

where R is an alkyl group having from 10–18 carbon atoms, and each $R^1$ is, independently, methyl, ethyl, or 2-hydroxethyl. Preferably, R is from 12 to about 16 carbon atoms, i.e. coconut, lauryl, or myristyl. Most preferably R is $C_{12}$. Each $R^1$ is independently, preferably, methyl or 2-hydroxyethyl. The amount of amine oxide surfactant in the concentrate is from about 1 to about 9 percent, by weight, of the total weight of the concentrate, preferably, from about 2 to about 7 weight percent.

The anionic surfactant is an alkali metal or ammonium salt of an alkylsulfate, olefinsulfonate, alkylethersulfate, alkylarylsulfonate, alkylarylsulfate, alkylarylether sulfates, alkylarylether sulfonates, or the like, where the alkyl group is minimally $C_{12}$, or if alkylaryl, the alklaryl group is minimally $C_{16}$, and the number of alkylene oxide groups, if present, is from 2 to 4. Preferably, the alkyl groups are straight chain alkyl groups. The amount of anionic surfactant is from about 1 to about 8 percent by weight, preferably, from about 2 to about 6 percent by weight relative to the total weight of the concentrate. Preferably, the chain length of the alkyl group of the anionic surfactant should be approximately equal to that of the amine oxide.

The ratio of amine oxide surfactant to anionic surfactant ranges from 4:1 to 1:4, preferably from 1.5:1 to 1:1.5.

The hydrophobically modified polymer contains a hydrophobic portion and a hydrophilic portion derived from anionic monomers such as acrylates, maleates and terpolymers containing these moieties. Such anionic monomers may be reacted with vinyl surfactant monomers derived from polyoxyalkylene adducts of long chain alcohols or phenols to form the co-and terpolymers. The polyoxyalkylene moiety is derived all, or in large part, from ethylene oxide, propylene oxide, butylene oxide, or a higher alkylene oxide; as well as mixtures thereof.

The hydrophobe, in suitable cases, may be derived from a long chain α-olefin oxide. In such cases, the polycarboxylic acid may be reacted directly with the α-olefin oxide.

The hydrophobically-modified polymer surfactant may also be a co-polymer or a terpolymer of an acrylate or an acrylic acid, such as methylacrylate, methylmethacrylate, octyl acrylate and the like, alkokylated acrylates, alkyl alkoxylated acrylates, alkylaryl alkoxylated acylates where the alkyl group was from about 8 to 18 carbon atoms, and the alkoxy group is lower alkylene oxide, such as ethylene oxide propylene oxide butylene oxide, as well as mixtures of the aforementioned compounds. Generally, the polymer is one having either an acrylate, maleate, or sulfonate hydrophobic group which is modified by a pendant alkyl moiety through either a carboxylate ester or sulfonate ester linkage.

Preferred hydrophobically modified polymers are supplied by Rohm and Haas under the name ACUSOL TM. Preferred are ACUSOL TM 810 and ACUSOL TM 820. Likewise, the polymers supplied by Alco Chemical under the name Alcogum, such as the Alco SL and L series and, in particular, Alcogum SL-70 and Alcogum L-30 may be used. The amount of hydrophobically modified polymer is from 1 to 5 percent, preferably 2 to 4 percent, by weight, relative to the total weight of the concentrate.

The chelating or sequestering agents suitable for use in the invention are the alkali metal salts of ethylenediamine tetraacetic acid (EDTA), nitrilotriacetic acid, and like compounds; anionic polyelectrolytes such as the polyacrylates, maleates, sulfonates and their copolymers, and alkali metal gluconates. Also suitable as chelating agents are the organophosphonates such as 1-hydroxyethylidene-1, 1-diphosphonic acid, amino (trimethylenephosphonic acid), hexamethylenediaminetetra (methylenephosphonic acid), diethylenetriaminepenta (methylene phosphonic acid), and 1,2-phosophonobutane-1,2,4-tricarboxylic acid. Such chelating agents are used in the range of from 0.2 to 2.5 percent, by weight, and preferably 0.4 to about 2 percent, by weight, relative to the weight of the concentrate.

A solvent or non-ionic surfactant "thinner" is a necessary component of the subject invention. Among the solvents suitable as thinners are alcohols such as methanol, ethanol, isopropanol, and glycol ethers such as propylene glycol methyl ether and dipropylene glycol methylether. Non-ionic surfactant thinners may be alkylphenol oxyalkylates or fatty alcohol oxyalkylates containing from 4 to 10 oxyalkylene groups. Mixtures of these thinners are advantageously used. The amount of thinner ranges from 1 to about 5 percent, by weight, preferably 1.5 to about 3.5 percent, by weight, relative to the total weight of the concentrate.

An alkali is also a necessary part of the final composition. The alkali may be derived from soda ash, potash, sodium hydroxide, or potassium hydroxide. Calculated on the basis of a 50 weight percent solution of sodium hydroxide, the amount of alkali is from 2 to about 20 percent, more preferably from 8 to about 12 percent, by weight, relative to the total weight of the concentrate.

Thus, the final concentrate may contain, in percent by weight, the following components:

| Components | Weight Percent | |
|---|---|---|
| | Overall | Preferable |
| Amine oxide | 1–9 | 3–8 |
| Anionic surfactant | 1–8 | 3–7 |
| Hydrophobically modified polymer | 1–5 | 2–4 |
| Chelating agent | 0.2–2.5 | 0.4–2 |
| Thinner | 1–5 | 1.5–3.5 |
| Alkali | 2–20 | 8–12 |
| Water | Remainder | Remainder |

To prepare the concentrates of the subject invention, the ingredients are added to water one at a time and agitated until thoroughly mixed before addition of the next ingredient. In use, the concentrates of the subject invention are diluted to working concentrations of from about 2 to about 6 percent of the concentrate per total weight of the working solution.

The following examples will further illustrate the preparation and performance of the preferred compositions in accordance with the present invention. However, it is to be understood that these examples are given by way of illustration and not limitation. In these example parts means parts by weight, unless otherwise noted.

Example I

A mixture of 82.9 parts water, 1.9 parts myristyl dimethylamine oxide, 0.4 parts octylphenoxy polyethoxy ethanol (HLB=13.5), 1.5 parts sodium lauryl sulfate, 1.5 parts isopropyl alcohol, 3.8 parts Acusol-820, and 8.0 parts caustic soda 50 percent solution, was blended in a mixing vessel equipped with a suitable agitator. The ingredients were added one at a time and mixed thoroughly before each addition. The finished product was a transparent and homogeneous liquid concentrate. The Brookfield viscosity of a 10 percent solution was 500 cps (LV #2, 12 rpm).

Example II

A mixture of 78.1 parts water, 2.5 parts myristyl dimethylamine oxide, 0.5 parts octyl phenol ethoxylate (10 ethylene oxide groups), 2.5 parts isopropyl alcohol, 1.9 parts sodium lauryl sulfate, 3.5 parts Acusol 820, and 11.0 parts caustic soda 50 percent solution, was blended in the same manner as in Example 1. The finished product was a transparent and homogenous liquid concentrate. The Brookfield viscosity of 10 percent solution was 950 cps. (LV #2, 12 rpm)

Example III

A mixture of 77.1 parts water, 0.5 parts octylphenoxy polyethoxy ethanol (HLB=13.5), 2.1 parts myristyl dimethylamine oxide, 1.8 parts sodium lauryl sulfate, 2.5 parts isopropyl alcohol, 2.0 parts Acusol 810, 3.0 parts Acusol 820, and 11.0 parts of a 50 percent caustic soda solution, was blended as described in the previous examples. The finished product was a viscous translucent and homogeneous liquid concentrate. The Brookfield viscosity of a 10 percent solution was 550 cps (LV #2, 12 rpm).

Example IV

A mixture of 73.4 parts water, 2.6 parts myristyl dimethylamine oxide, 2.1 parts sodium lauryl sulfate, 2.5 parts dipropyl glycol methyl ether, 0.9 parts polyacrylate (M. W. 4500), 4.5 parts Acusol 820, and 14.0 parts caustic soda, 50 percent solution, was blended as described previously. The finished product was a viscous, however, pumpable liquid concentrate. The Brookfield viscosity of a 10 percent solution was 2200 cps (LV #3, 12 rpm).

Example V

A mixture of 74.3 parts deionized water, 2.5 parts Dipropylene glycol methyl ether, 2.1 parts sodium lauryl sulfate, 2.6 parts myristyl dimethylamine oxide, 2.0 parts Acusol 460N, 4.0 parts Acusol 820, and 12.5 parts caustic soda 50 percent solution, was mixed as previously described. The finished product was a clear, transparent and homogeneous liquid. The Brookfield viscosity of a 5% solution was 80 cps (LV #2, 30 rpm) and that of a 10 percent solution was 3400 cps (LV #3, 12 rpm).

Example VI

To the test the efficacy of the cleaners hereof it was necessary to first determine the gel retention strength, i.e. the degree of adherence to the surface to be cleaned.

The gel strength or retention of cleaning chemicals adhering to surfaces can be tested by applying cleaners at working concentrations on stainless steel coupons (3"×6"), allowing the excess solution to drain, and then weighing the coupons. The weight difference establishes the amount of cleaner solution adhered the to surface of the coupon. This indicates the difference in ability of cleaners to cling to the surface.

Another test procedure that is quite reliable is viscosity measurement. In this method, the Brookfield viscosity measurement is done on a 10 percent w/w solution of samples to be tested at a specified temperature.

The Brookfield Viscosity Procedure, generally involves the following steps:

a. Prepare a 10 percent w/w of samples to be tested.
b. Allow the test solutions to stand for 20 minutes to recover their viscosity. Since these solutions are thixotropic, they must be allowed to recover after being sheared through mixing.
c. Adjust the temperature of test solutions to the same temperature at @22°-25° C.
d. Measure viscosity of the test solutions at exactly 10 seconds after the spindle has started.

For the results from Brookfield Viscosity measurement to be reliable and reproducible, variables such as temperature, concentration, rest time, and measurement time must be controlled.

Using the above Brookfield Viscosity Procedure, the cleaner concentrates of the examples hereof were tested for gel retention. The following sets forth the results of the tests.

TABLE I

Test Results on Gel Retention

| Thickening Technology | Brookfield Viscosity of a 10% w/w solution, cps | |
|---|---|---|
| Present Invention | | |
| Example 1 | 500 | (LV #2, 12 rpm) |
| Example 2 | 950 | (LV #2, 12 rpm) |
| Example 3 | 550 | (LV #2, 12 rpm) |
| Example 4 | 2200 | (LV #2, 12 rpm) |
| Example 5 | 3400 | (LV #3, 12 rpm) |

This result was, then, compared to a series of solutions from amine oxide-based concentrates and cationic-based cleaner concentrates. The formulation for amine oxide based compounds were as follows:

| Ingredient, amt. | Cleaner 1 | Cleaner 2 | Cleaner 3 |
|---|---|---|---|
| Water, soft | 45.0 | 44.0 | 32.0 |
| EDTA, sequestrant | 5.0 | 6.0 | |
| Myristal dimethyl amine oxide | 11.0 | 11.0 | 10.0 |
| Sodium xylene sulfonate | 6.0 | 4.0 | 8.0 |
| Sodium lauryl sulfate | 10.0 | 10.0 | 9.0 |
| Caustic, 30% Sodium hydroxide | 20.0 | | 16.0 |
| Potassium hydroxide | | 10.0 | |
| Sodium Silicate | | 11.0 | |
| 1,2, phosphonobutane - 1,2,4 - tricarboxylic acid | | | 1.0 |
| Sodium hypochlorite | | | 24.0 |
| dipropylene glycol methyl ether | 3.0 | 4.0 | |

The cationic-based concentrates are commercially available from Diversey Corp. as Shuregel 4 and 5, and are denoted CLEANER 4 and CLEANER 5, respectfully, below.

The results of the tests were as follows:

GEL RETENTION

| Cleaner | Brookfield Viscosity of a 10% w/w Solution, cps | |
|---|---|---|
| Amine Oxide Based | | |
| Cleaner 1 | 110 | (LV #2, 30 rpm) |
| Cleaner 2 | 60 | (LV #2, 30 rpm) |
| Cleaner 3 | 95 | (LV #2, 30 rpm) |
| Catonic-Based | | |
| Cleaner 4 | 265 | (LV #2, 30 rpm) |
| Cleaner 5 | 160 | (LV #2, 30 rpm) |

The data shows the excellent gel retention of the cleaners hereof when contrasted with the amine oxide-based and cationic-based.

Example VII

The present high retention cleaners were then tested for cleaning efficacy. The testing was conducted on a stainless steel panel (3'×6') using raw chicken as soil. The procedure used was as follows:

a. Raw chicken, with skin on, was rubbed on the surface of a stainless steel coupon.
b. The coupon was rinsed with cold water.
c. A 5 percent w/w cleaning solution to be tested was prepared and transferred into a SHURFOAM 1401 tank. SHURFOAM 1401 is a foam applicator from Diversey Corp. which requires pre-dilution of cleaners. Cleaning solutions were applied by air pressure and foam consistency was adjusted.
d. The foamed cleaner was sprayed on the soiled surface.
e. The cleaner and soil on the surface was rinsed with cold water after 15 minutes.
f. The sheeting effect and cleanliness on the surface was visually observed.

Using a 3 percent w/w use solution of the concentrate of Example V a stainless steel panel was tested for cleaning using the above-defined procedure. It was observed that the soiled surface was absolutely cleaned. There was no sign of fat residues left on the surface. Rinsibility was excellent.

Using a 5 percent w/w solution of the Cleaner 3 product, the outlined cleaning procedure was, again, repeated. It was observed that the soiled surface was quite clean. Only a few tiny fat spots on the surface. Rinsibility was very good.

Using a sample of Cleaning 4, tile test procedure outlined above was repeated. In this case, it was observed that the detergency was poor. Poor sheeting and soil were, also, noted. The amount of soil left on the surface was almost similar to the soiled surface prior to cleaning.

It is to be understood that modifications and various changes in the compositions of the non-chlorinated, low alkaline high retention liquid cleaners disclosed herein may occur to those skilled in the art based on this disclosure. It is to be understood that these modifications are within the scope of this invention. From the above it is to be appreciated that the present cleaners exhibit good cleaning performance.

Having, thus, described the invention what is claimed is:

1. An aqueous concentrate suitable for dilution with water to form a viscous cleaning solution, comprising:

(a) from about 1 to about 9 weight percent of an amine oxide having the formula:

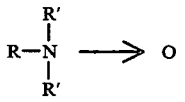

wherein R is $C_{10}$ to $C_{18}$ and wherein each $R^1$, independently, is selected from the group consisting of methyl, ethyl, and 2-hydroxyethyl;

(b) from about 1 to about 8 weight percent of an alkyl anionic surfactant selected from the group consisting of the ammonium and alkali metal salts of the alkyl sulfates, olefin sulfonates, alkylether sulfates, alkylaryl sulfonates, alkylarylether sulfates, alkylarylether sulfonates and mixtures thereof, wherein said alkyl groups are minimally $C_{12}$ when aryl groups are not present, and wherein said alkylaryl groups are minimally $C_{16}$, and wherein said ether groups comprise a polyoxyalkylene group containing from 2 to 4 $C_2$ to $C_4$ alkylene oxide residues;

(c) from about 1 to about 5 weight percent of a polymer having hydrophobic groups selected from the group consisting of acrylates, maleates and sulfonates, said polymer hydrophobically modified by pendant alkyl moieties through carboxylic ester or sulfonate ester linkage;

(d) a thinner selected from the group consisting of lower alkanols, lower alkanol ethers, and nonionic surfactants prepared by oxyalkylating an alkylphenol or a fatty alcohol with from 4 to 10 $C_2$-$C_3$ alkylene oxide moleties; and (e) an alkali.

2. The composition of claim 1 further comprising a chelating agent selected from the group consisting of organophosphonates, the alkali metal salts of ethylene diamine tetraacetic acid, nitrilotriacetic acid, polyacrylates, polymaleates, polysulfonates, copolymers and terpolymers of the acrylates, maleates and sulfonates, and mixtures thereof.

3. The composition of claim 2 wherein said chelating agent is an organophosphonate chelating agent.

4. The composition of claim 3 wherein said organophosphonate chelating agent is selected from the group consisting of 1-hydroxyethylidene-1, 1-diphosphonic acid, amino (trimethylenephosphonic acid), hexamethylenediaminetetra (methylene phosphonic acid), diethylenetriaminepenta(methylene phosphonic acid), and 1,2-phosphonobutane-1,2,4-tricarboxylic acid.

5. The composition of claim 1 wherein said polymer is a hydrophobically-modified polyacrylate polymer.

6. The composition of claim 2 wherein said polymer is a hydrophobically-modified polyacrylate.

7. The composition of claim 4 wherein said polymer is a hydrophobically modified polyacrylate.

8. The composition of claim 1, which upon dilution with water at a ratio of 1 part by weight of said composition to 9 parts water by weight, has a viscosity of 400 cps or more.

9. The composition of claim 8 wherein said viscosity is 1000 cps or more,

10. A process for cleaning of hard surfaces comprising:

a) applying to a soiled surface the composition of claim 1 diluted with from 94 to about 98 parts by weight of water;

b) rinsing said surface with water.

11. A process for cleaning of hard surfaces comprising:

a) applying to a soiled surface the composition of claim 2 diluted with from 94 to about 98 parts by weight of water;

b) rinsing said surface with water.

12. A process for cleaning of hard surfaces comprising:

a) applying to a soiled surface the composition of claim 1 diluted with from 94 to about 98 parts by weight of water;

b) rinsing said surface with water.

13. A process for cleaning of hard surfaces comprising:

a) applying to a soiled surface the composition of claim 3 diluted with from 94 to about 98 parts by weight of water;

b) rinsing said surface with water.

14. A process for cleaning of hard surfaces comprising:

a) applying to a soiled surface the composition of claim 5 diluted with from 94 to about. 98 parts by weight of water;

b) rinsing said surface with water.

15. An aqueous concentrate suitable for dilution with water to form a viscous cleaning solution, comprising, by weight:

(a) from about 1 to 9 percent of an amine oxide having the formula:

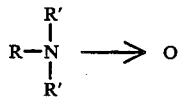

wherein R is $C_{10}$-$C_{18}$ alkyl and wherein each $R^1$, independently, is selected from the group consisting of methyl, ethyl and 2-hydroxyethyl;

(b) from about 1 to 8 percent of an alkyl anionic surfactant selected from the group consisting of the ammonium and alkali metals salts of the alkyl sulfates, olefin sulfonates, alkylether sulfates, alkylaryl sulfonates, alkylaryether sulfates, alkylaryether sulfonates and mixtures thereof, wherein said alkyl groups are minimally $C_{12}$ when aryl groups are not present, and wherein said alkylaryl groups are minimally $C_{16}$, and said ether groups comprise a polyoxyalkylene group containing 2 to 4 $C_2$ to $C_4$ alkylene oxide residues;

(c) from about 1 to about 8 percent of a polymer having hydrophilic groups selected from the group consisting of acrylates, maleates and sulfonates, said polymer being hydrophobically modified by pendant alkyl moleties through carboxylic ester or sulfonate ester linkage.

(d) an effective amount of a thinner selected from the group consisting of lower alkanols, lower alkanol ethers, and nonionic surfactants prepared by oxyalkylating an alkylphenol or a fatty alcohol with from 4 to 10 $C_2$-$C_3$ alkylene oxide moleties; and (e) an effective amount of an alkali.

16. The composition of claim 15 further comprising an effective amount of a chelating agent selected from the group consisting of the alkali metal salts of ethylenediamine tetraacetic acid, nitrilotriacetic acid, polyacrylates, polymaleates, polysulfonates, co-polymers and terpolymers of the acrylates, maleates and sulfonates, as well as mixtures of the chelating agents.

* * * * *